United States Patent [19]

Minasy et al.

[11] Patent Number: 4,751,500

[45] Date of Patent: Jun. 14, 1988

[54] DETECTION OF UNAUTHORIZED REMOVAL OF THEFT DETECTION TARGET DEVICES

[75] Inventors: Arthur J. Minasy, Woodbury; Michael N. Cooper, Hewlett, both of N.Y.

[73] Assignee: Knogo Corporation, Hauppauge, N.Y.

[21] Appl. No.: 13,120

[22] Filed: Feb. 10, 1987

[51] Int. Cl.[4] ..... G08B 13/24

[52] U.S. Cl. ..... 340/572

[58] Field of Search ..... 340/572, 551

[56] References Cited

U.S. PATENT DOCUMENTS

| | | | |
|---|---|---|---|
| 2,474,271 | 6/1949 | Meyer | 250/303 |
| 2,774,060 | 12/1956 | Thompson | 340/572 |
| 3,493,955 | 2/1970 | Minasy | 340/572 |
| 3,713,133 | 1/1973 | Nathans | 340/572 |
| 3,747,086 | 7/1973 | Peterson | 340/551 |
| 3,810,147 | 5/1974 | Lichtblau | 340/572 |
| 3,820,103 | 6/1974 | Fearon | 340/551 |
| 3,820,104 | 6/1974 | Fearon | 340/551 |
| 3,858,280 | 1/1975 | Martens | 24/150 R |
| 3,911,534 | 10/1975 | Martens et al. | 24/150 R |
| 4,321,586 | 3/1982 | Cooper et al. | 340/572 |
| 4,531,264 | 7/1985 | Minasy | 24/155 BR |
| 4,590,461 | 5/1986 | Cooper | 340/572 |
| 4,623,877 | 11/1986 | Buckens | 340/572 |
| 4,642,613 | 2/1987 | Pokalsky | 340/572 |

*Primary Examiner*—Glen R. Swann, III

*Attorney, Agent, or Firm*—Fitzpatrick, Cella, Harper & Scinto

[57] ABSTRACT

An article surveillance system includes a first monitor 26 at a store exit way 12 and second monitors 34 in the dressing rooms 20 and rest rooms 22 in the store to detect security tags 24 attached to articles of merchandise 14. When the tags 24 are attached to the merchandise they hold a ring 82 against the tags causing them to have a high resonant frequency which is detected by the first monitors 26 but not the second monitors 34. If the tags are removed from the merchandise in a dressing room or rest room, the ring falls away from the tag and its resonant frequency lowers and the tag is then detected by the second monitor 34.

32 Claims, 6 Drawing Sheets

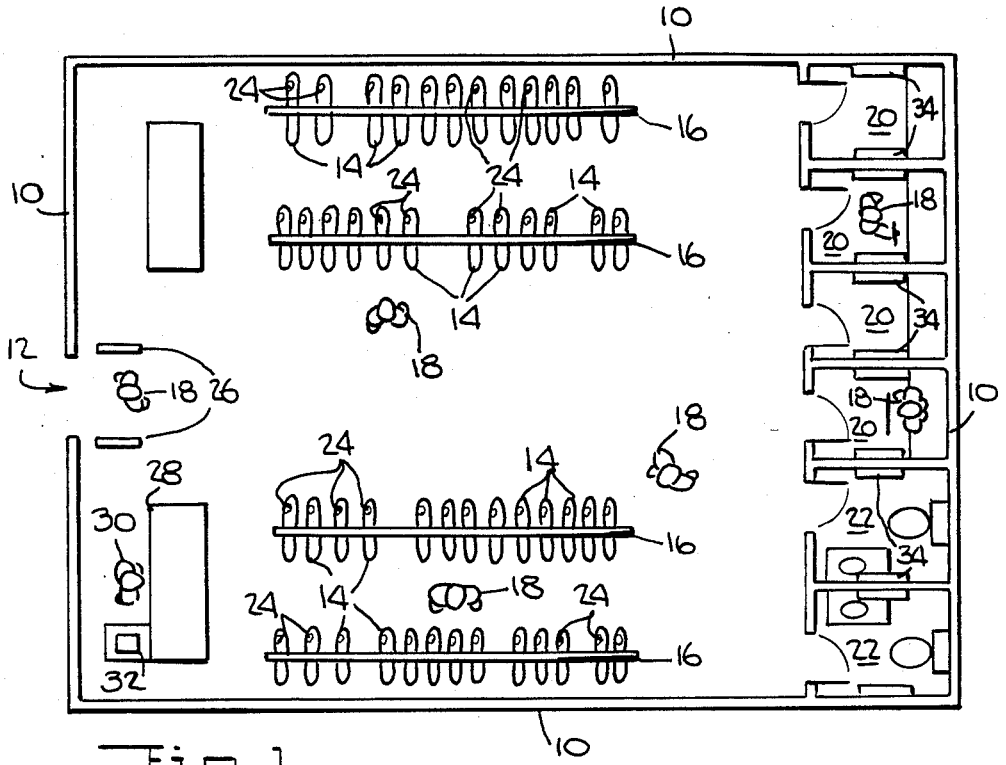
Fig. 1.
Fig. 6.
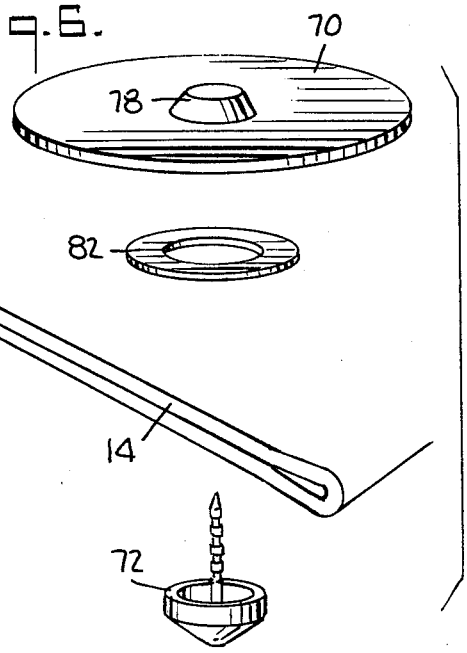
Fig. 5.
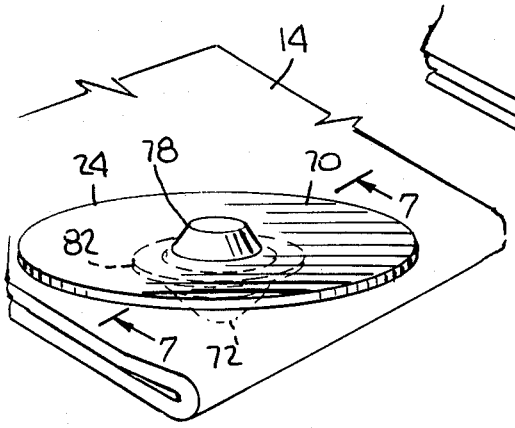

Frequency
Store Exit Interrogation Frequency (1920-2220 KHz)
Resonant Freq. Of Attached Targets (2070 KHz)
Resonant Freq. Of Detached Targets (1970 KHz)
Store Exit Signal Gate 56
Store Exit Noise Gate 58
Dressing Room Signal Gate 56'
Dressing Room Noise Gate 58'
On
Off
Time

DETECTION OF UNAUTHORIZED REMOVAL OF THEFT DETECTION TARGET DEVICES

BACKGROUND OF THE INVENTION

1. Field of the Invention

This invention relates to electronic article surveillance systems and more particularly it concerns arrangements for detecting unauthorized removal of surveillance system security tags from articles of protected merchandise.

2. Description of the Prior Art

Electronic article surveillance systems for protecting articles of merchandise from theft are well known. In all of these systems the articles of merchandise to be protected have a security tag containing a "target" element attached to them and when the article is carried from a protected area, such as a store, an antenna at the exit from the protected area senses the target element and sounds an alarm. When the article of merchandise is purchased, the store clerk either deactivates the target or removes the security tag so that the merchandise can be taken from the protected area without activating the alarm.

Systems have been proposed which utilize so called "active" targets which contain their own power and give off distinctive electromagnetic signals or disturbances which are detected when they are carried past sensing antennas at the store exit. U.S. Pat. No. 2,474,271 describes one such system.

Most systems however, use "passive" targets or responders which respond to electromagnetic radiation supplied from an interrogation antenna at the store exit and produce distinctive electromagnetic disturbances which are then detected. U.S. Pat. Nos. 3,493,955, 2,774,060, 3,500,373, 4,321,586 and 4,623,877 and 4,642,613 describe such responder systems.

It is important that the target not be deactivatible or removable from the merchandise except by special means controlled by the store clerk. Various devactivation and removal arrangements have been proposed and utilized. U.S. Pat. No. 3,810,147 proposes to provide a fusible link in a resonant circuit target which, when subjected to radiation at the appropriate power and frequency, would melt the link and change the distinctive resonant characteristics of the target so that it cannot be detected.

U.S. Pat. Nos. 3,747,086, 3,820,103 and 3,820,104 describe the provision of high coercivity magnetic elements mounted on a soft magnetic strip target so that, when the elements are magnetized they prevent the soft magnetic strip from producing characteristic harmonics of an interrogation field.

U.S. Pat. Nos. 3,858,280, 3,911,534, 4,531,264 and 4,590,461 describe specially detachable locking arrangements for security tags which allow them to be removed from the merchandise only with a special tool controlled by the store clerk. The electromagnetic characteristics of the targets contained in these tags is not altered and they may be reused, after removal, to protect other articles of merchandise. These security tags are generally in the form of plastic wafers and are fastened to the merchandise by means of a tack-like fastening element whose shank passes through the merchandise and enters into a locking mechanism on the tag. The locking mechanism can be released by a special tool, e.g. a special magnet, controlled by the store clerk.

A problem has arisen in connection with removable security tags in electronic article surveillance systems. Although the locking mechanism can be released legitimately only with a special tool, it may be possible, by continued working with a large and powerful tool, for example, pruning shears or a heavy duty cable cutter, eventually to destroy the locking mechanism and then remove the security tag. Although it would not be possible to use such tools in the public areas of a store without arousing suspicion, it is possible to use them without detection in the privacy of a dressing room or a rest room in the store. Thus a thief can bring merchandise into the store dressing room and, without detection, work with a large tool for as long as necessary to destroy the security tag locking mechanism and then remove the tag and target from the merchandise. The protection of merchandise in private areas such as in dressing rooms and rest rooms has been a difficult problem because a certain degree of privacy must be accorded to store patrons in those areas.

SUMMARY OF THE INVENTION

The present invention overcomes the problems of the prior art and provides novel arrangements which enable the detection of unauthorized removal of security tags from merchandise in private areas of a store without affecting the privacy that must be maintained in such areas.

According to one aspect of the invention there is provided a novel electronic article surveillance system for protecting merchandise from theft from a store having a private room located within a protected area of the store. The system comprises a first monitor which is arranged to respond to a first distinctive electromagnetic disturbance in an exit path from the protected area of the store, a second monitor which is responsive to a second distinctive electromagnetic disturbance within the private room to produce an alarm, and a security tag which is fastened to an article of merchandise in the protected area and can be removed only with a special tool. The security tag contains a target which produces the first characteristic disturbance when the tag is fastened to the article of merchandise and it produces the second disturbance when the tag is removed from the article of merchandise.

When the article of merchandise with the security tag fastened to it is taken into the private room the target does not produce the second distinctive disturbance and therefore no alarm is produced. If, however, the security tag is removed from the merchandise in the private room its target then produces the second distinctive disturbance which is detected by the second monitor to produce an alarm. Also, if merchandise with the security tag attached is taken from the protected area of the store the target will produce the first distinctive disturbance which is then detected by the first monitor to produce an alarm.

According to a second aspect of the invention there is provided a novel security tag for use in an electronic article surveillance system. This novel security tag comprises a casing, a fastener for securing the casing to an article of merchandise. The fastener is releasable to allow separation of the casing from the article of merchandise only by means of a special tool. A target is mounted in the casing. The target is arranged such that it produces a first distinctive electromagnetic disturbance characteristic when the fastening means secures the casing to the article of merchandise and a second disturbance electromagnetic characteristic when the casing is separated from the article of merchandise.

BRIEF DESCRIPTION OF THE DRAWINGS

FIG. 1 is a diagramatic plan view of a protected area of store, including private rooms, in which the present invention is used;

FIG. 5 is a perspective view showing a security tag according to the present invention fastened to an article of merchandise;

FIG. 6 is an exploded view showing the security tag of FIG. 5 removed from the article of merchandise;

DETAILED DESCRIPTION OF THE PREFERRED EMBODIMENTS

Figures 2, 3:
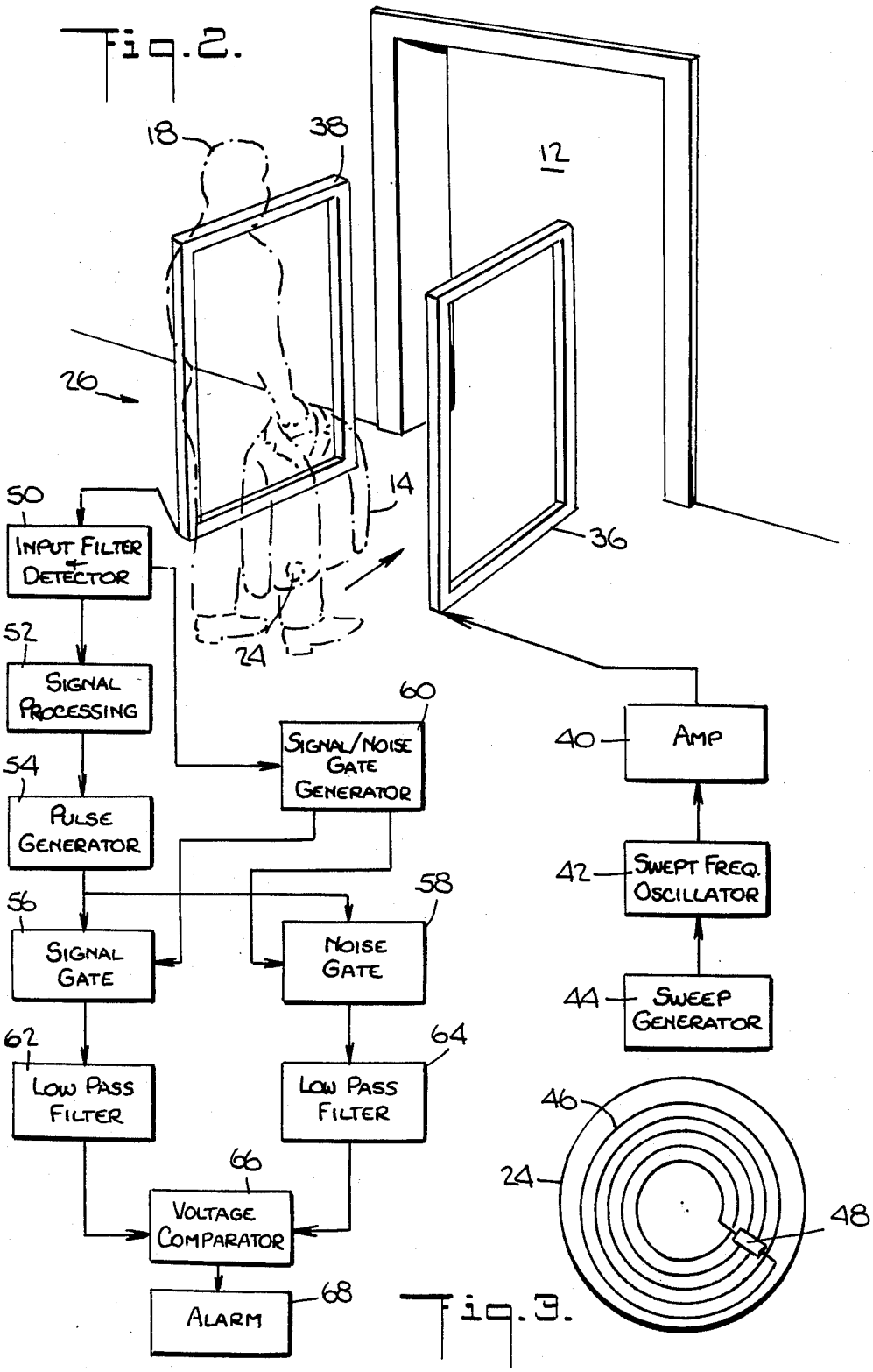
FIG. 2 is a diagramatic illustration and block diagram of a monitoring arrangement at an exit of the protected area of FIG. 1.
FIG. 3 is a circuit diagram of a target which is detected by the monitoring arrangement of FIG. 2.

FIG. 1 shows, in plan view, the interior of a retail store. The store has outer walls 10 and an entrance and exit way 12. Articles of merchandise 14 are hung on racks 16 inside the store so that they can be examined by store customers 18.

There are also provided inside the store, private rooms such as dressing rooms 20 and rest rooms 22 for the use of store customers. Customers may bring articles of merchandise 14 into these private rooms and try them on so that they can decide whether to purchase them.

Special security tags 24 are fastened to the articles of merchandise 14. These security tags contain targets which protect the merchandise from theft. A store exit monitor 26 is arranged at the exit way 12 of the store; and if an article of merchandise 14 with an attached security tag 24 is carried through the exit way 12 past the monitor 26, the monitor will detect the security tag target and actuate an alarm. When, on the other hand, a customer makes a legitimate purchase, the customer takes the merchandise 14 to a counter 28 where a store clerk 30 removes the security tag 24 using a special tool 32. The customer may then take the merchandise through the exit way 12 without activating the alarm.

The security tags 24 can be quite securely fastened to the merchandise 14 so as to prevent unauthorized removal and yet can be guickly removed by the store clerk using the special tool 32. Nevertheless, by use of a large tool such as pruning shears or heavy cable cutters, it may be possible, after a time, to destroy the locking mechanism on the security tag and remove it from the merchandise. Any such activity would be readily noticed if it were attempted in the public area of the store. However, if a shoplifter takes the merchandise into one of the dressing rooms 20 or rest rooms 22, the shoplifter is assured of privacy and may work on the fastener of the security tag for as long as necessary to destroy it without being noticed. The shoplifter may then leave the security tag in the private room and take the merchandise out through the exit way 26 without being detected by the monitor 12.

The arrangements of the present invention serve to protect against such unauthorized security tag removal. As shown in FIG. 1, dressing room and rest room monitors 34 are provided in each of the dressing rooms 20 and rest rooms 22. These monitors are similar in construction to the store exit monitor 26; however, they respond to a somewhat different electromagnetic disturbance than the store exit monitors. Thus when articles of merchandise 14 having security tags 24 attached to them are taken into a dressing room or rest room in order to try on the merchandise the monitor 34 will not produce an alarm. However, according to the present invention, the security tags 24 are of special construction and, when removed from the articles of merchandise 14, they produce a different electromagnetic disturbance that is detected by the dressing room and rest room monitor 34. Accordingly, whenever a security tag is removed from an article of merchandise in one of the dressing rooms 20 or rest rooms 22, the monitor therein will immediately produce an alarm.

The present invention in its broadest aspects is not limited to any particular type of monitoring system, security tag or target; however, for purposes of illustration there is described herein a preferred arrangement with a swept frequency security system and plastic wafer security tags containing resonant circuit targets. FIG. 2 shows, in schematic and block diagram form, a swept radio frequency store exit monitor 26 located at the exit way 12 of the store. This monitor may have the same construction as described in U.S. Pat. No. 4,321,586 and that description is fully incorporated herein by reference.

As shown in FIG. 2 there is provided on opposite sides of the exit way 12 a transmitting antenna 36 and a receiving antenna 38. Any store customer who leaves the store must walk between these two antennas; and the articles of merchandise which the customer carries pass through electromagnetic fields generated in the vicinity of these antennas.

The transmitting antenna is energized by the output of an amplifier 40 which in turn receives a continuous swept radio frequency signal from a swept frequency oscillator 42. The oscillator in turn is driven by a sweep generator 44. The sweep generator produces a 220 hertz signal which causes the swept frequency oscillator to vary its output frequency between 1920 and 2,220 kilohertz at a 220 hertz rate. This swept radio frequency signal is converted by the transmitting antenna 36 to a swept radio frequency electromagnetic field in the exit way 12.

It will be understood that the frequencies and sweep rates described herein are given only by way of example and are not critical to the invention.

Turning now to FIG. 3, it will be seen that the target contained in the security tag 24 comprises a spiral coil 46 and a capacitor 48 connected in a loop to form a resonant electrical circuit. The coil and capacitor are tuned so that their resonant frequency is within the frequency sweep range of the transmitter circuit i.e. between 1,920 and 2,220 kilohertz. Consequently twice during each sweep cycle, the transmitted frequency is the same as the resonant frequency of the target circuit. When the security tag 24 is in the exit way 12 its target circuit is driven into resonance each time the transmitted frequency passes the resonance frequency of the target circuit. This results is a series of distinctive electromagnetic disturbances which are received by the receiving antenna 38 and detected by the receiving circuits connected to that antenna.

As shown in FIG. 2, the receiving antenna 38 is connected to input filters and detector 50 which remove the radio frequency components from the received signals. The remaining signal components are then passed through signal processing circuits 52 which examine the components for the distinctive characteristics that are produced by a true resonant circuit having the same Q as the target circuits.

The output of the signal processing circuits 52 is supplied to a pulse generator 54. The pulse generator produces a pulse each time the transmitter frequency sweeps past the resonance frequency of a target circuit in the exit way 12. The pulse generator output is applied simultaneously to a signal gate 56 and a noise gate 58. These gates are opened alternatively by signals from a signal/noise gate generator 60. This gate generator in turn is connected to the receiver input circuits 50 and receives the sweep portion of the received signal.

The gate generator 60 is set to open the signal gate 56 during those portions of the frequency sweep cycle which bracket the resonant frequency of the target circuits and to open the noise gate 58 during the remaining portions of the frequency sweep cycle.

The outputs of the signal and noise gates 56 and 58 are applied, respectively, to associated low pass filters or accumulators 62 and 64 which accumulate pulses from the pulse generator 54. The outputs of the low pass filters 62 and 64 are compared in a comparator 66. When the number of pulses which pass through the open signal gate 56 becomes large in comparison to the number of pulses which pass through the open noise gate 58, the voltage comparator 66 supplies a signal to actuate an alarm 68.

Figure 4:
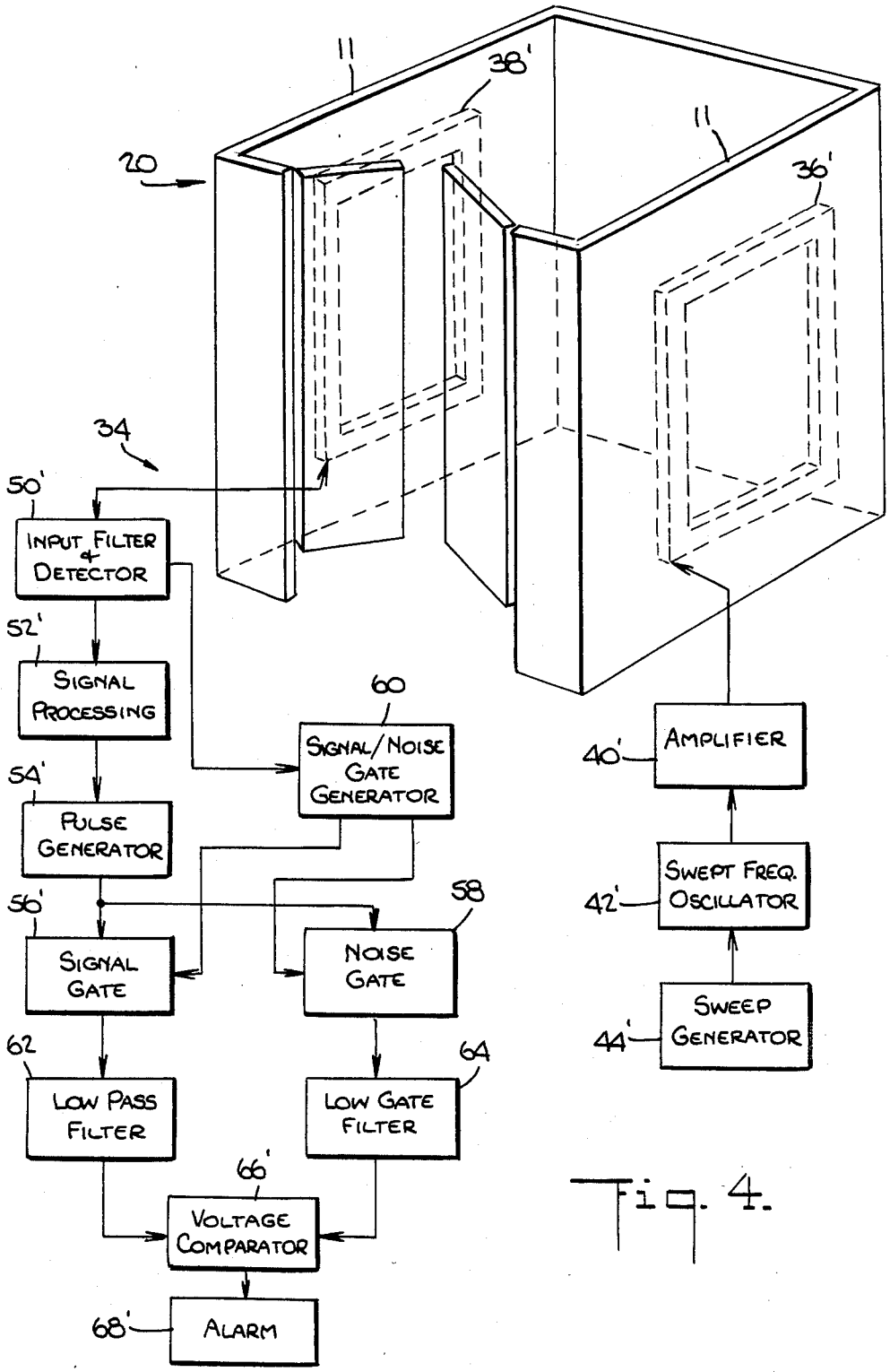
FIG. 4 is a diagramatic illustration and block diagram of a monitoring arrangement at a private room of FIG. 1.

FIG. 4 shows a dressing room 20 fitted out with a dressing room monitor 34. The dressing room 20 typically is a small compartment having just enough space for one individual to change clothes. The dressing room monitor includes a transmitting antenna 36' and a receiving antenna 38' mounted in opposite walls 11 of the dressing room. The electrical components of the dressing room monitor 34 are essentially the same as those of the store exit monitor 26 and accordingly the same reference numbers primed are used in FIG. 4 to represent components which are counterparts of components in the store exit monitor 26 of FIG. 2. The dressing room monitor 34 operates in the same manner as the store exit monitor 36 except that the swept frequency oscillator 42' is set to sweep through a range of frequencies that is somewhat lower than the range of frequencies produced by the swept frequency oscillator 42 of the store exit monitor. In this example, the oscillator 42' is swept between 1,820 and 2,120 kilohertz. In addition, the gate generator 60' of the dressing room monitor 34 is set to open the signal gate 56' only during the transmission of a narrow range of transmitted frequencies near the center of the sweep range (i.e. 1,970 kilohertz) during each transmitter frequency sweep cycle. This narrow range of transmitter frequencies does not include the resonant frequency of the target circuits when their respective target devices are attached to article of merchandise. However, if a security tag 24 according to the invention is removed from an article of merchandise, the resonant frequency of its target circuit becomes shifted to that region of the transmitted frequency sweep which occurs while the signal gate 56' is opened. As a result detected pulses caused by the target circuit pass through the signal gate and activate the alarm 68'.

Figure 7:
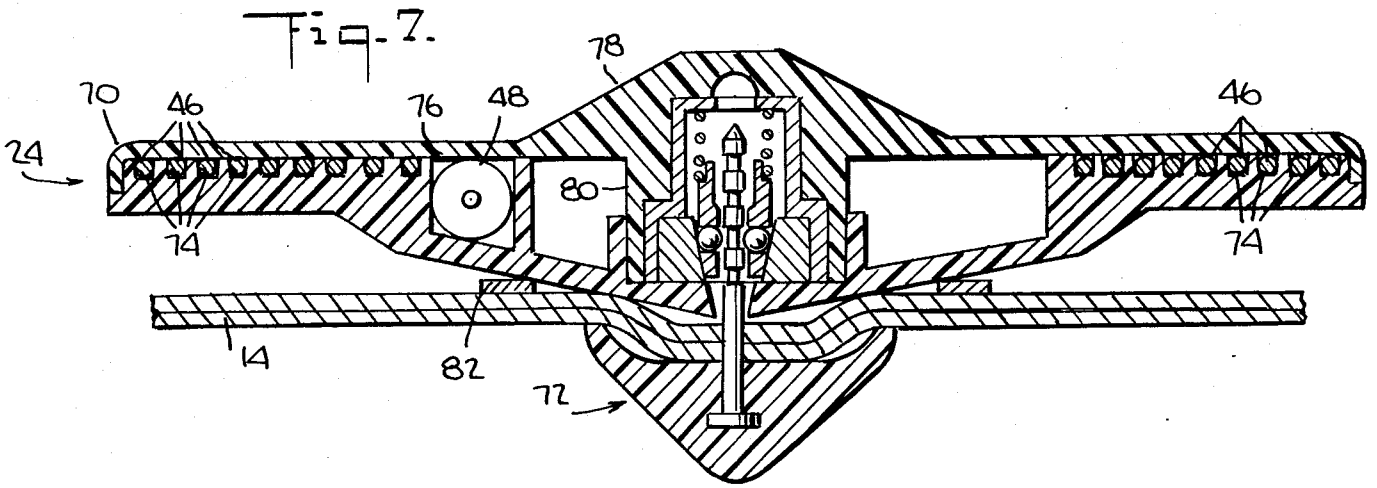
FIG. 7 is an enlarged cross sectional view taken along line 7—7 of FIG. 5.

The construction of the security tag 24 and the manner in which the resonant frequency of its target circuit becomes shifted when the tag is detached from an article of merchandise is illustrated in FIGS. 5–7. The basic construction of the security tag 24 is the same as described in U.S. Pat. No. 4,590,461 and the description in that patent is incorporated herein by reference. As shown in FIG. 7, the target device 24 has a molded plastic casing 70 which is fastened by means of a tack like fastener element 72 to a sheet shaped portion of the merchandise 14, e.g. the hem or sleeve of a garment. This arrangement allows the garment to be tried on in a dressing room, yet the presence of the casing 70 leaves no doubt that the garment is electrically protected and will cause an alarm to sound if it is carried through the store exit way 12 with the security tag 24 attached to it. The coil 46 is held in place in a spiral slot 74 in the lower half of the casing 70; and the capacitor 48 is located in a compartment 76 formed in the casing.

The casing 70 is also formed with a lock housing 78 which accommodates a releasable locking mechanism 80. The locking mechanism 80 securely grips the shank of the fastener element 72 when it enters the casing 70 from the lower side after passing through the merchandise 14. When the fastener element 72 is held in place by the locking mechanism, the casing 70 is securely held to the merchandise 14 and, under normal conditions, it cannot be removed from the merchandise. However, when a powerful magnetic force is applied with the special tool 32 at the counter 28 (FIG. 1), the lock housing 74 the locking mechanism is released and the fastener element may easily be removed to allow separation of the security tag 24 from the merchandise.

Under some conditions, however, a person may, by working long enough on the lock housing 74, eventually destroy the housing and the locking mechanism and thereby remove the security tag 24 from the merchandise. Usually this is attempted in a dressing room or a rest room where there is a measure of privacy. This invention permits the detection of such removal without otherwise violating the privacy of the dressing room or rest room, by providing arrangements which change the characteristic electromagnetic disturbance produced by the target circuit when it is removed from the merchandise. In the illustrated embodiment the resonant frequency of the target circuit is shifted when it is removed from the merchandise.

As shown in the exploded view of FIG. 6, a copper ring 82 is interposed between the merchandise 14 and the casing 70 of the security tag 24. The shank of the fastener element 72 passes through the center of the copper ring 82. When the security tag 24 is fastened to the merchandise 14 the copper ring 82 is held tightly between the casing 70 and the merchandise as shown in FIGS. 5 and 7.

When the copper ring 82 is in the position shown in FIGS. 5 and 7 adjacent, or in close proximity, to the coil 46 and the capacitor 48, the copper ring interacts electrically with the coil and capacitor and shifts their resonant frequency upwardly. Thus, in the illustrated embodiment, where the coil 46 and capacitor 48 by themselves have a resonant frequency of 1,970 kilohertz, when the copper ring 82 is positioned close to the coil and capacitor their resonant frequency becomes 2,070 kilohertz. The amount of frequency shift depends on the dimensions of the ring 82.

It has been found that a frequency shift of 100 kilohertz can be obtained with a copper ring having an outer diameter of 1.25 inches (3.175 cm) an inner diameter of 1.187 inches (3.015 cm) and a thickness of 0.125 inches (0.317 cm).

In the preferred embodiment, the store exit monitor 26 operates to detect security tags 24 taken through the store exit way 12 whether or nor those tags are attached to articles of merchandise. The dressing room monitors 34, on the other hand, operate to detect only security tags which are removed from merchandise within the dressing rooms 20 or the rest rooms 22. This permits store patrons to take merchandise with the security tags attached into these rooms to try on the merchandise without causing an alarm to be actuated.

Figure 8:
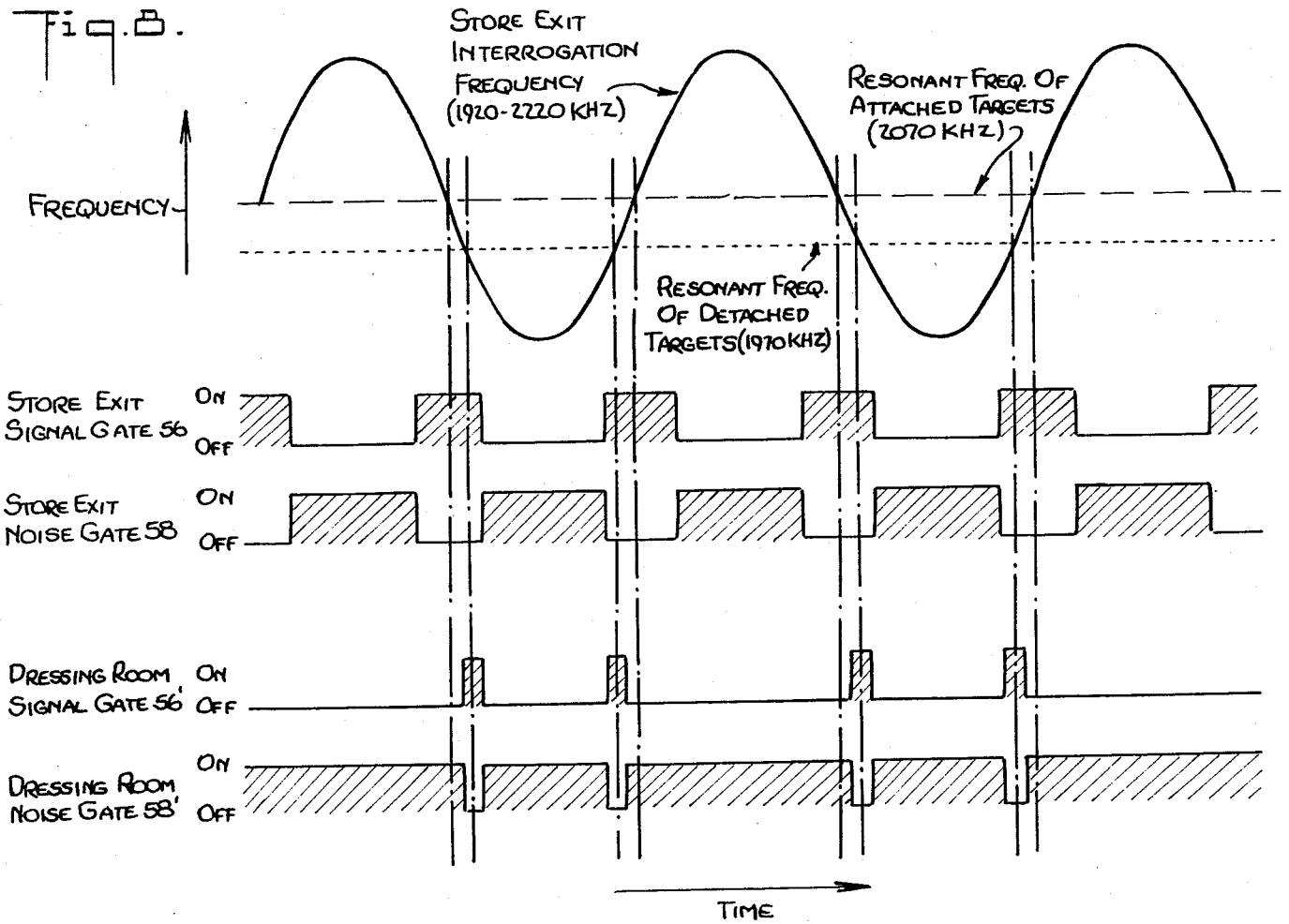
FIG. 8 is a waveform and a timing diagram for showing the detection of targets, according to a preferred embodiment the present invention, at a store exit and at a dressing room.
Figure 9:
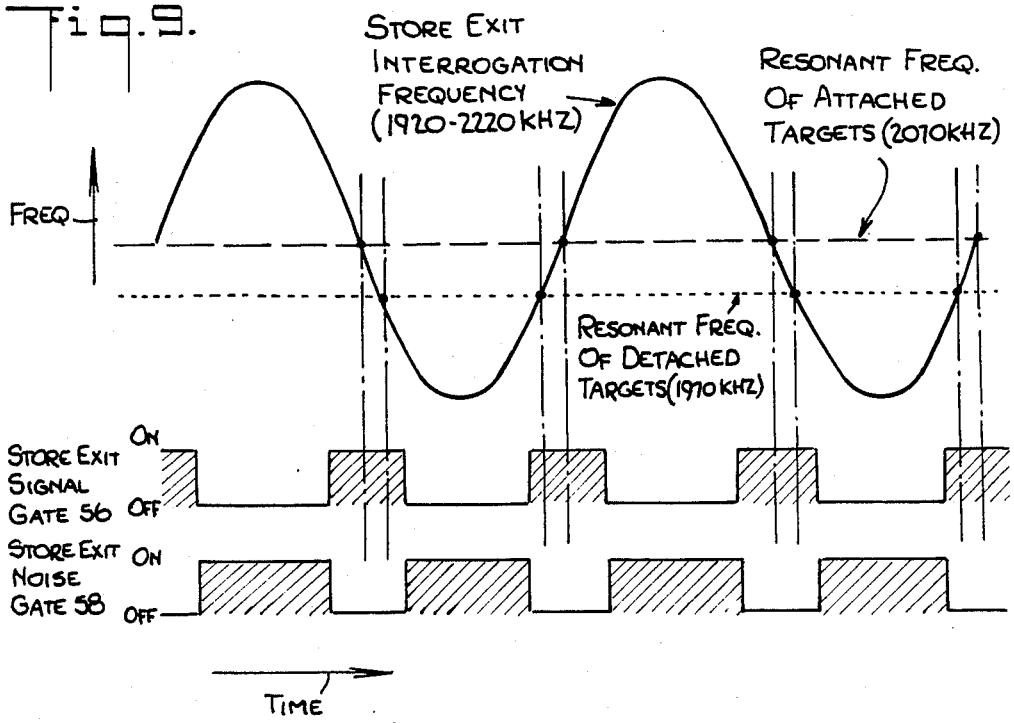
FIGS. 9 and 10 are waveforms and timing diagrams for showing the detection of targets according to an alternative form of the present invention.
Figure 10:
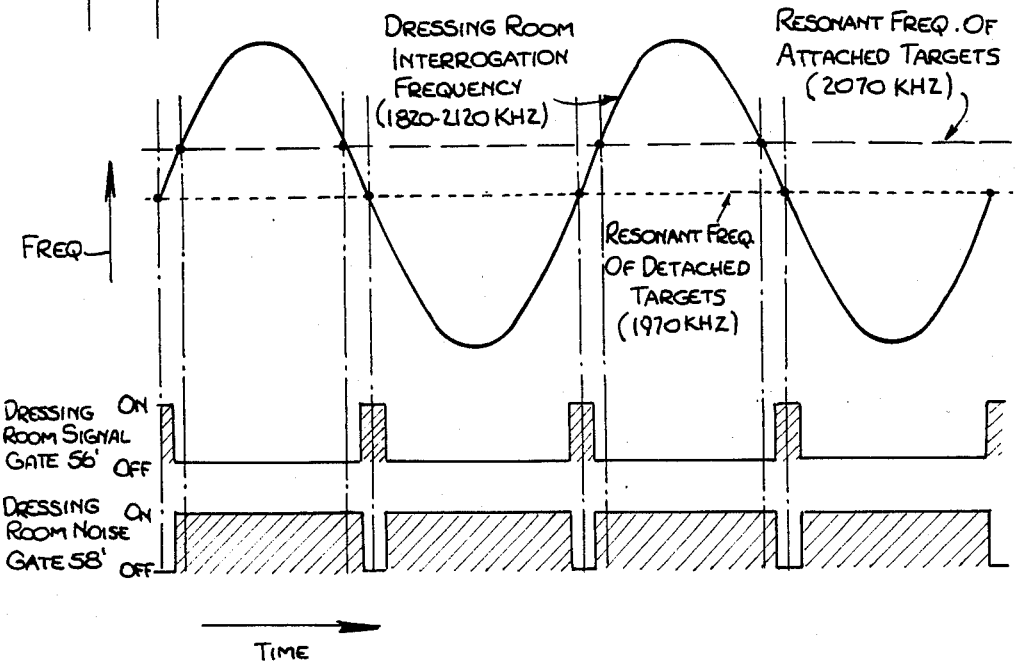

The timing diagrams of FIGS. 8, 9 and 10 illustrate the manner in which the store exit and dressing room monitors 26 and 34 operate to selectively detect attached or removed security tags. As shown in FIGS. 8 and 9, the center frequency of the store exit swept frequency oscillator 42 is set at the resonant frequency of the target circuit of the attached security tags 24 with the copper ring 82 in place (i.e. 2,070 kilohertz). The frequency sweep is from 1,920 to 2,220 kilohertz, which also includes the resonant frequency of the target circuit of the detached security tags 24 with the copper ring 82 removed (i.e. 1,970 kilohertz). In this case the timing of the signal gate 56 is set so that the gate is on while the interrogation frequency, i.e. the output of the swept frequency oscillator 42 passes both through 2,070 kilohertz and 1,970 kilohertz. Thus should either an attached or a detached security tag 24 be carried through the exit way 12, the pulses produced when the interrogation frequency sweeps past the resonant frequency of the tag's target circuit will occur while the signal gate is on. These pulses will pass through to the voltage comparator 66 and cause an alarm to be actuated.

As shown in FIG. 10, the center frequency of the dressing room monitors is set at the resonant frequency of the detached security tag 24, with the copper ring 82 removed (i.e. 1,970 kilohertz). The frequency sweep is from 1,820 to 2,120 kilohertz. This also includes the resonant frequency of the target circuit of the attached security tags 24 with the copper ring 82 in place (i.e. 2,070 kilohertz). However, in this case, the timing of the signal gate 56' is such that this gate is on only while the interrogation frequency, i.e. the output of the swept frequency oscillator 42' passes through 1,970 kilohertz. The signal gate 56' is off, and the noise gate 58' is on, at the times when the interrogation frequency passes through the resonant frequency of the target circuits of the attached security tags, i.e. 2,070 kilohertz. Consequently when a garment with a security tag attached is brought into a dressing room 20 or a rest room 22 the pulses produced by the tag's resonant circuit will occur only while the signal gate 56' is off and its noise gate 58' is on; and the alarm will not be actuated. If however, the security tag 24 is removed from the garment while in the dressing room or rest room, the copper ring 82 will fall away from the resonant circuit and the resonant frequency of the circuit will shift downwardly to 1,970 kilohertz. As a result, the pulses generated by the resonant circuit will occur while the signal gate 5' is on and this will actuate the alarm 68'. Alternately, as shown in FIG. 8, the dressing room signal gates 56' may be set to be "on" when the sweep frequency is at 1,970 kilohertz and "off" when the sweep frequency is at 2,070 kilohertz and the dressing room noise gates 58' may be set to be "on" when the sweep frequency is at 2,070 kilohertz and "off" when the sweep frequency is at 1,920 kilohertz, thus permitting the store exit and dressing room monitors to have the same sweep frequency.

Figure 11:
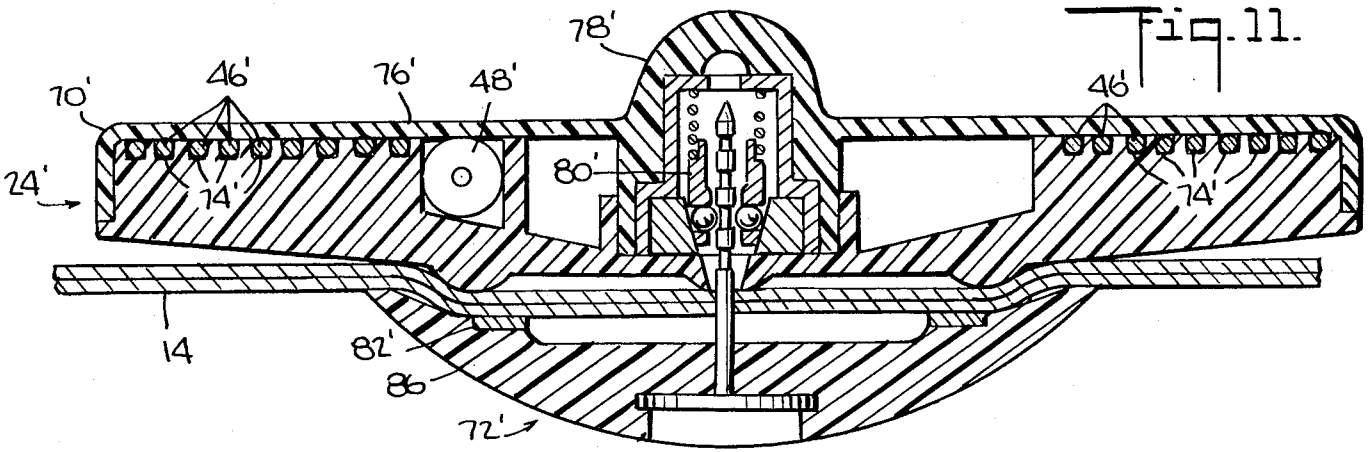
FIG. 11 is a view similar to FIG. 7 but showing an alternate security tag according to the present invention.

FIG. 11 shows an alternative arrangement for controlling the resonant frequency of the target circuit so that it shifts to a lower frequency when the security tag is detached from the merchandise. In FIG. 11 a security tag 24' is shown which is similar in construction to the security tag 24 of FIG. 7. The basic construction of the security tag 24' is the same as shown U.S. Pat. No. 4,187,509.

As can be seen, the outer configuration of the security tag 24' is somewhat modified from that of the security tag 24. However the security tag 24' has all the same basic elements of the security tag 24 and those elements which have counterparts in FIG. 7 are given the same reference numerals with a prime.

In the arrangement of FIG. 11, the fastener 72' is provided with an enlarged molded plastic head 86 in which the copper ring 82' is cemented. Thus when the shank of the fastener 72' is passed through the merchandise 14 and locked into the locking mechanism 80' of the security tag, the copper ring 82' is held in proper positional relationship to the coil 46' and capacitor 48' of the target resonant circuit to shift its frequency upward. If the locking mechanism 80' or the fastener 72' are destroyed so as to remove the fastener from the wafer housing 70', the copper ring 82' will become separated from the resonant circuit and the resonant frequency of the circuit will decrease. Thus, the removed target will be detected in the same manner as in the embodiment of FIGS. 5–7.

It will be appreciated from the foregoing that the present invention provides a novel electronic article surveillance system and security tag construction which enables the detection of unauthorized removal of security tags from articles of merchandise in dressing rooms and rest rooms without otherwise affecting the privacy of persons using those rooms.

We claim:

1. An electronic article surveillance system for protecting merchandise from theft from a store having a private room located within a protected area of the store, said system comprising a first monitor arranged to respond to a first charactertistic electromagnetic disturbance in an exit path from the protected area of the store, a second monitor which is responsive to a second characteristic electromagnetic disturbance within the private room to produce an alarm, and a security tag which is constructed to be fastened to an article of merchandise and to be removable therefrom only with a special tool, said security tag being constructed to produce the first characteristic electromagnetic disturbance when it is fastened to an article of merchandise and to produce the second characteristic electromagnetic disturbance when it is removed from the article of merchandise, said first monitor also being responsive to said second characteristic electromagnetic disturbance to produce an alarm.

2. An electronic article surveillance system according to claim 1 wherein said security tag contains a target which produces said first and second distinctive electromagnetic disturbances in response to interrogation signals and wherein said first and second monitors each include means for producing said interrogation signals.

3. An electronic article surveillance system according to claim 2 wherein said target is a resonant circuit and wherein said security tag is constructed such that said target has a first resonant frequency when said security tag is fastened to an article of merchandise and a second resonant frequency when said security tag is removed from the article of merchandise.

4. An electronic article surveillance system according to claim 3 wherein said first and second monitors produce swept frequency interrogation signals which sweep repetitively through a range of frequencies including said first and second resonant frequencies, said first monitor being responsive to electromagnetic disturbances produced by a resonant circuit which is resonant at said first resonant frequency and said second monitor being responsive only to electromagnetic disturbances produced by a resonant circuit which is resonant at said second resonant frequency.

5. An electronic article surveillance system according to claim 4 wherein said first and second monitors include respectively, first and second signal gates through which signals produced upon detection of said first and second electromagnetic disturbances must pass to actuate an alarm, wherein said first monitor further includes first signal gate operating means to open said first signal gate during the times that its interrogation signal is being swept through said first resonant frequency and wherein said second monitor further includes second signal gate operating means to open said second signal gate during the times that its interrogation is being swept through said second resonant frequency.

6. An electronic article surveillance system according to claim 5 wherein said first signal gate operating means also maintains said first signal gate open during the times that its interrogation signal is being swept through said second resonant frequency.

7. An electronic article surveillance system for protecting merchandise from theft from a store having a private room located within a protected area of the store, said system comprising a first monitor arranged to respond to a first characteristic electromagnetic disturbance in an exit path from the protected area of the store, a second monitor which is responsive to a second characteristic electromagnetic disturbance within the private room to produce an alarm, and a security tag which is constructed to be fastened to an article of merchandise and to be removable therefrom only with a special tool, said security tag containing a target which is constructed to produce the first characteristic electromagnetic disturbance when it is fastened to an article of merchandise and to produce the second characteristic electromagnetic disturbance when it is removed from the article of merchandise, said security tag including an element which, when positioned adjacent said target, changes the target's electrical characteristics so that it produces said first distinctive electromagnetic disturbances, said element being held in position adjacent said target when said security tag is fastened to an article of merchandise and is released from said security tag when said security tag is separated from said article of merchandise.

8. An electronic article surveillance system according to claim 7 wherein said security tag comprises a casing which contains said target and a tack-like fastener having a shank which projects through an article of merchandise and is held inside said casing by a locking mechanism therein.

9. An electronic article surveillance system according to claim 8 wherein said element is in the form of a ring and is held in place between said article of merchandise and said casing with the shank of said fastener passing through said ring.

10. An electronic article surveillance system according to claim 9 wherein said target is a resonant electrical circuit whose frequency is shifted by said ring when said ring is positioned adjacent said casing.

11. An electronic article surveillance system according to claim 8 wherein said element is in the shape of a ring and is embedded in the head of said tack-like fastener.

12. An electronic article surveillance system according to claim 11 wherein said target is a resonant electrical circuit whose frequency is shifted by said ring when said ring is positioned adjacent said casing.

13. An electronic article surveillance system according to claim 7 wherein said security tag contains a target which produces said first and second distinctive electromagnetic disturbances in response to interrogation signals and wherein said first and second monitors each include means for producing said interrogation signals.

14. An electronic article surveillance system according to claim 13 wherein said target is a resonant circuit and wherein said security tag is constructed such that said target has a first resonant frequency when said security tag is fastened to an article of merchandise and a second resonant frequency when said security tag is removed from the article of merchandise.

15. An electronic article surveillance system according to claim 14 wherein said first and second monitors produce swept frequency interrogation signals which sweep repetitively through a range of frequencies including said first and second resonant frequencies, said first monitor being responsive to electromagnetic disturbances produced by a resonant circuit which is resonant at said first resonant frequency and said second monitor being responsive only to electromagnetic disturbances produced by a resonant circuit which is resonant at said second resonant frequency.

16. An electronic article surveillance system according to claim 15 wherein said first monitor is responsive to electromagnetic disturbances produced by a resonant circuit which is resonant at said second resonant frequency.

17. An electronic article surveillance system according to claim 15 wherein said first and second monitors include respectively, first and second signal gates through which signals produced upon detection of said first and second electromagnetic disturbances must pass to actuate an alarm, wherein said first monitor further includes first signal gate operating means to cause said first signal gate to pass signals which occur during the times that its interrogation signal is being swept through said first resonant frequency and wherein said second monitor further includes second signal gate operating means to cause said second signal gate to pass signals which occur during the times that its interrogation is being swept through said second resonant frequency.

18. An electronic article surveillance system according to claim 17 wherein said first signal gate operating means also causes said first signal gate to pass signals which occur during the times that its interrogation signal is being swept through said second resonant frequency.

19. A security tag for use in an electronic article surveillance system, said tag comprising a casing, a fastener for securing the casing to an article of merchandise, said fastener being releasable only by a special tool to allow separation of the casing from the article of merchandise, a target mounted in the casing, said target being arranged such that it produces a first distinctive electromagnetic disturbance when the fastener secures the casing to the article of merchandise and a second distinctive electromagnetic disturbance when the casing is separated from the article of merchandise, said security tag including an element which, when positioned adjacent said targe, changes the target's electrical characteristics so that is produces said first distinctive electromagnetic disturbances, said element being held in position adjacent said target when said fastener holds said casing to an article of merchandise but separates from said target when said casing is separated from said article of merchandise.

20. A security tag according to claim 19 wherein said target is constructed to produce said first and second distinctive electromagnetic disturbances at first and second frequencies respectively.

21. A security tag according to claim 19 wherein said target is constructed to produce said first and second electromagnetic disturbances in response to interrogation signals.

22. A security tag according to claim 19 wherein said element is held against said casing by said fastener.

23. A security tag according to claim 22 wherein said fastener is a tack like device having a shank which passes through an article of merchandise and is held inside said casing by a lock assembly therein.

24. A security tag according to claim 23 wherein said element is in the shape of a ring and wherein the shank of said fastener passes through the center of said ring.

25. A security tag according to claim 24 wherein said element is fixed in the head of said fastener.

26. A security tag according to claim 19 wherein said target is a resonant electrical circuit.

27. A security tag according to claim 26 wherein said target is arranged to have a first resonant frequency when said fastener secures the casing to the article of merchandise and to have a second resonant frequency when said casing is separated from the merchandise.

28. A security tag according to claim 27 wherein said security tag includes an element whose electrical characteristics are such that when the element is positioned adjacent said casing, it changes the resonant frequency of the target from said second resonant frequency to said first resonant frequency.

29. A security tag according to claim 28 wherein said element is held adjacent said casing when said fastener holds said casing against an article of merchandise.

30. A security tag according to claim 29 wherein said element is an electrically conductive ring.

31. A security tag according to claim 30 wherein said fastener is a tack-like device having a shank which passes through said article of merchandise and said ring and into a locking mechanism in said casing.

32. A security tag according to claim 31 wherein said ring is mounted in the head of said fastener.

* * * * *

UNITED STATES PATENT AND TRADEMARK OFFICE

CERTIFICATE OF CORRECTION

PATENT NO. : 4,751,500

DATED : June 14, 1988

INVENTOR(S) : ARTHUR J. MINASY, ET AL.

It is certified that error appears in the above-identified patent and that said Letters Patent is hereby corrected as shown below:

COLUMN 2

Line 44, "second disturbance" should read --second characteristic disturbance--.
Line 61, "casing," should read --casing and--.

COLUMN 3

Line 5, "diagramatic" should read --diagrammatic--.
Line 8, "diagramatic" should read --diagrammatic--.
Line 13, "diagramatic" should read --diagrammatic--.
Line 21, "cross sectional" should read --cross-sectional--.

COLUMN 6

Line 18, "tack" should read --tack---.
Line 19, "sheet shaped" should read --sheet-shaped--.

COLUMN 7

Line 10, "(3.175 cm) an" should read --(3.175 cm), an--.
Line 35, "on" should read --"on"--.
Line 43, "on." should read --"on".--.
Line 53, "on" should read --"on"--.
Line 56, "off," should read --"off"--.
Line 56, "on," should read --"on",--.
Line 63, "off" should read --"off"--.
Line 64, "on;" should read --"on";--.

UNITED STATES PATENT AND TRADEMARK OFFICE

CERTIFICATE OF CORRECTION

PATENT NO. : 4,751,500

DATED : June 14, 1988

INVENTOR(S) : ARTHUR J. MINASY, ET AL.

It is certified that error appears in the above-identified patent and that said Letters Patent is hereby corrected as shown below:

COLUMN 8

Line 2, "signal gate 5'" should read --signal gate 56'--.

COLUMN 9

Line 64, "disturbances," should read --disturbance,--.

COLUMN 10

Line 65, "interrogation" should read --interrogation signal--.

COLUMN 11

Line 17, "targe," should read --target,--.
Line 18, "is" should read --it--.

UNITED STATES PATENT AND TRADEMARK OFFICE

CERTIFICATE OF CORRECTION

PATENT NO. : 4,751,500

DATED : June 14, 1988

INVENTOR(S) : ARTHUR J. MINASY, ET AL.

It is certified that error appears in the above-identified patent and that said Letters Patent is hereby corrected as shown below:

COLUMN 12

Line 2, "tack like" should read --tack-like--.

Signed and Sealed this

Third Day of January, 1989

*Attest:*

DONALD J. QUIGG

*Attesting Officer*

*Commissioner of Patents and Trademarks*